US005388301A

United States Patent [19]

Bosyj et al.

[11] Patent Number: 5,388,301

[45] Date of Patent: Feb. 14, 1995

[54] RIM SEAL FOR VACUUM CLEANER HAVING DUAL STORAGE TANKS

[75] Inventors: Nick M. Bosyj, North Canton; Donald R. Bowers; Nicholas Koukourakis, both of Akron; Conway Vincent, North Canton, all of Ohio

[73] Assignee: The Hoover Company, North Canton, Ohio

[21] Appl. No.: 126,985

[22] Filed: Sep. 27, 1993

Related U.S. Application Data

[63] Continuation of Ser. No. 5,024, Jan. 15, 1993, abandoned.

[51] Int. Cl.[6] ..... A47L 5/36; A47L 7/00

[52] U.S. Cl. ..... 15/327.1; 15/327.6; 15/328; 15/352; 15/353

[58] Field of Search ..... 15/320, 321, 352, 353, 15/327.1, 327.6, 328

[56] References Cited

U.S. PATENT DOCUMENTS

| | | | |
|---|---|---|---|
| 2,528,375 | 10/1950 | Lilly | 15/353 X |
| 3,570,222 | 3/1971 | Dudek et al. | 55/472 |
| 3,775,951 | 12/1974 | Eicholz et al. | 55/417 |
| 3,821,830 | 7/1974 | Sundheim | 15/321 |
| 3,939,527 | 2/1976 | Jones | 15/321 X |
| 4,087,881 | 5/1978 | Bates | 15/321 X |
| 4,200,951 | 5/1980 | Burgoon et al. | 15/321 |
| 4,367,565 | 1/1983 | Parise | 15/321 |
| 4,586,208 | 5/1986 | Trevarthen | 15/321 X |
| 4,654,926 | 4/1987 | McCambridge | 15/327 |
| 4,894,881 | 1/1990 | Palmer et al. | 15/353 X |
| 5,086,537 | 2/1992 | McDowell et al. | 15/353 |
| 5,205,014 | 4/1993 | Yoo | 15/353 |

*Primary Examiner*—Chris K. Moore

[57] ABSTRACT

The present invention discloses and teaches means for effecting a vacuum seal between the cover lid, outer tank and inner tank of a dual tank utility type vacuum cleaner wherein the inner tank is telescopingly positioned within the outer tank and suspended therein from the peripheral rim of the outer tank. The peripheral rims of the cover lid, inner tank and outer tank cooperate to fluidly isolate the inner tank from the outer tank and seal both tanks from the atmosphere.

14 Claims, 12 Drawing Sheets

RIM SEAL FOR VACUUM CLEANER HAVING DUAL STORAGE TANKS

This application is a continuation of Ser. No. 08/005,024, filed Jan. 15, 1993, now abandoned.

BACKGROUND OF THE INVENTION

The present invention relates to a dual chambered utility type wet/dry vacuum cleaner suitable for alternating wet/dry pickup. More particularly the present invention teaches cooperating rim structures for the cover lid, outer main body tank and inner whereby the inner tank is telescopingly positioned inside the outer main body tank suspended from the peripheral rim of the outer tank.

SUMMARY OF THE PRESENT INVENTION

The present invention discloses and teaches a peripheral rim structure for the cover lid, outer main body tank and inner tank whereby the rim structures cooperate to fluidly isolate the inner tank from the outer tank and seal both tanks from the atmosphere. The main body tank rim comprises two concentric vertically directed legs. The inner leg supports thereon a radially extending flange of the inner tank thereby creating a first surface to surface seal between the main body tank and the atmosphere. The cover lid also includes a radially directed flange seated upon the outer leg of the main body tank rim thereby providing a second surface to surface seal between the suspended inner tank and the atmosphere. An elastomeric "O" ring seal is positioned between the cover lid radial flange and the inner tank radial flange thereby effectively sealing the inner tank from the main body tank and the atmosphere. When the cover lid is compressively fastened to the main body tank, the elastomeric "O" ring is compressed thereby urging the inner tank radial flange against the inner leg of the outer main body tank peripheral rim further assuring isolation of the main body tank from the atmosphere.

BRIEF DESCRIPTION OF THE DRAWINGS

FIG. 2A presents a partial elevational view of the valve door showing the valve door in the wet vacuuming mode.

DESCRIPTION OF THE PREFERRED EMBODIMENT

Figure 1:
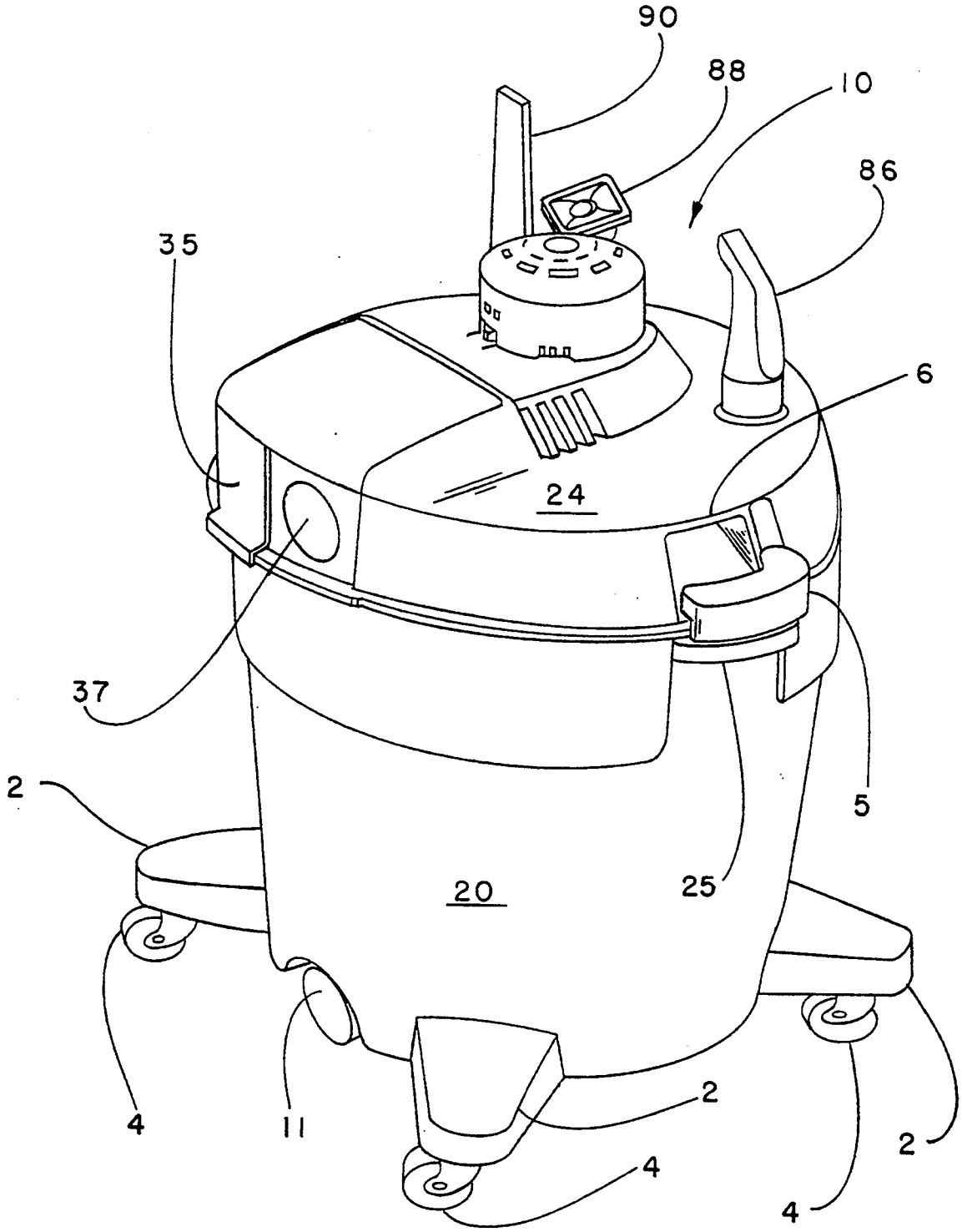
FIG. 1 is a perspective view of a tank type vacuum cleaner embodying the present invention.
Figure 2:
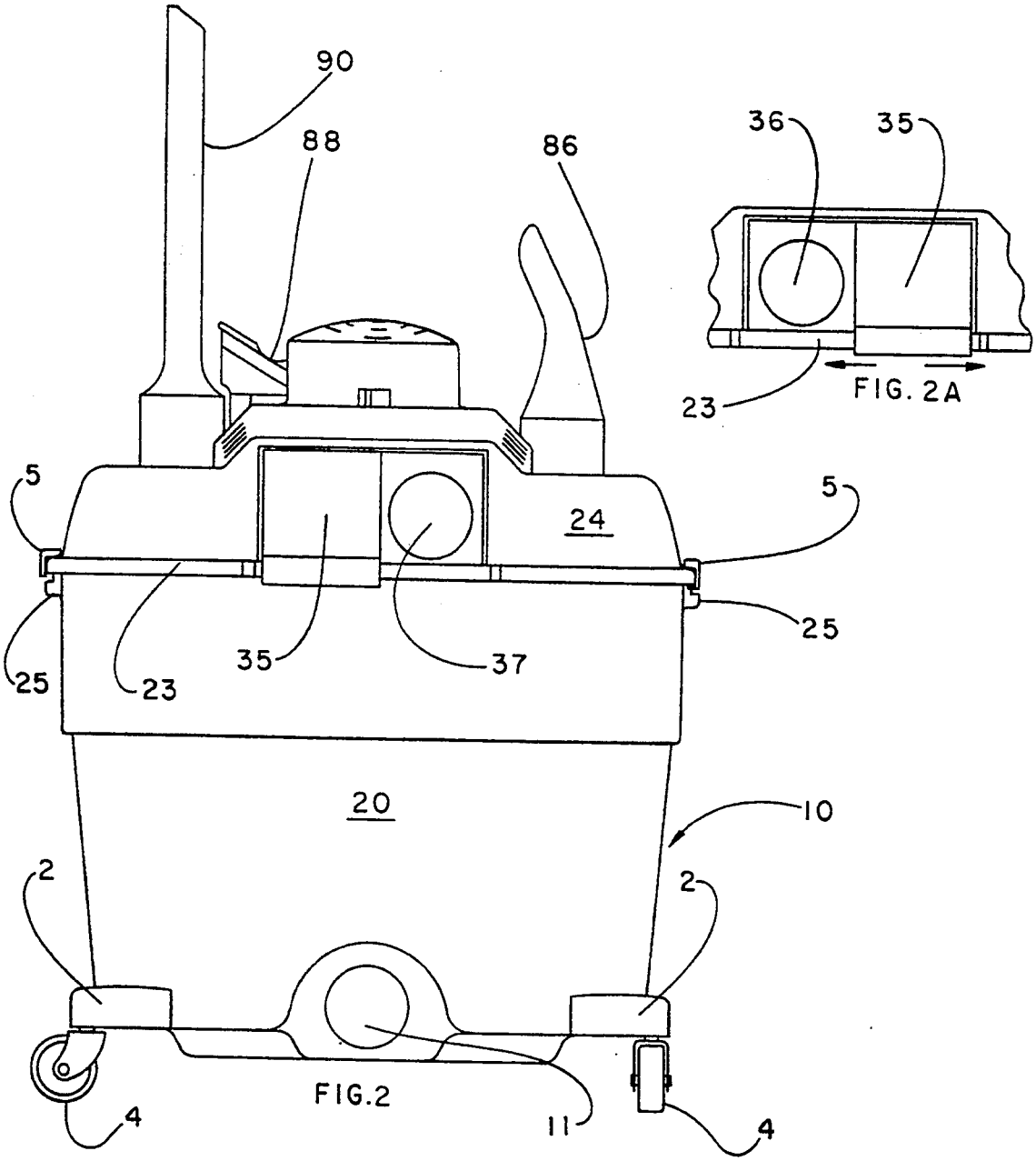
FIG. 2 is a front elevational view of the tank type vacuum cleaner shown in FIG. 1 with the valve door in the dry vacuuming mode.
Figure 3:
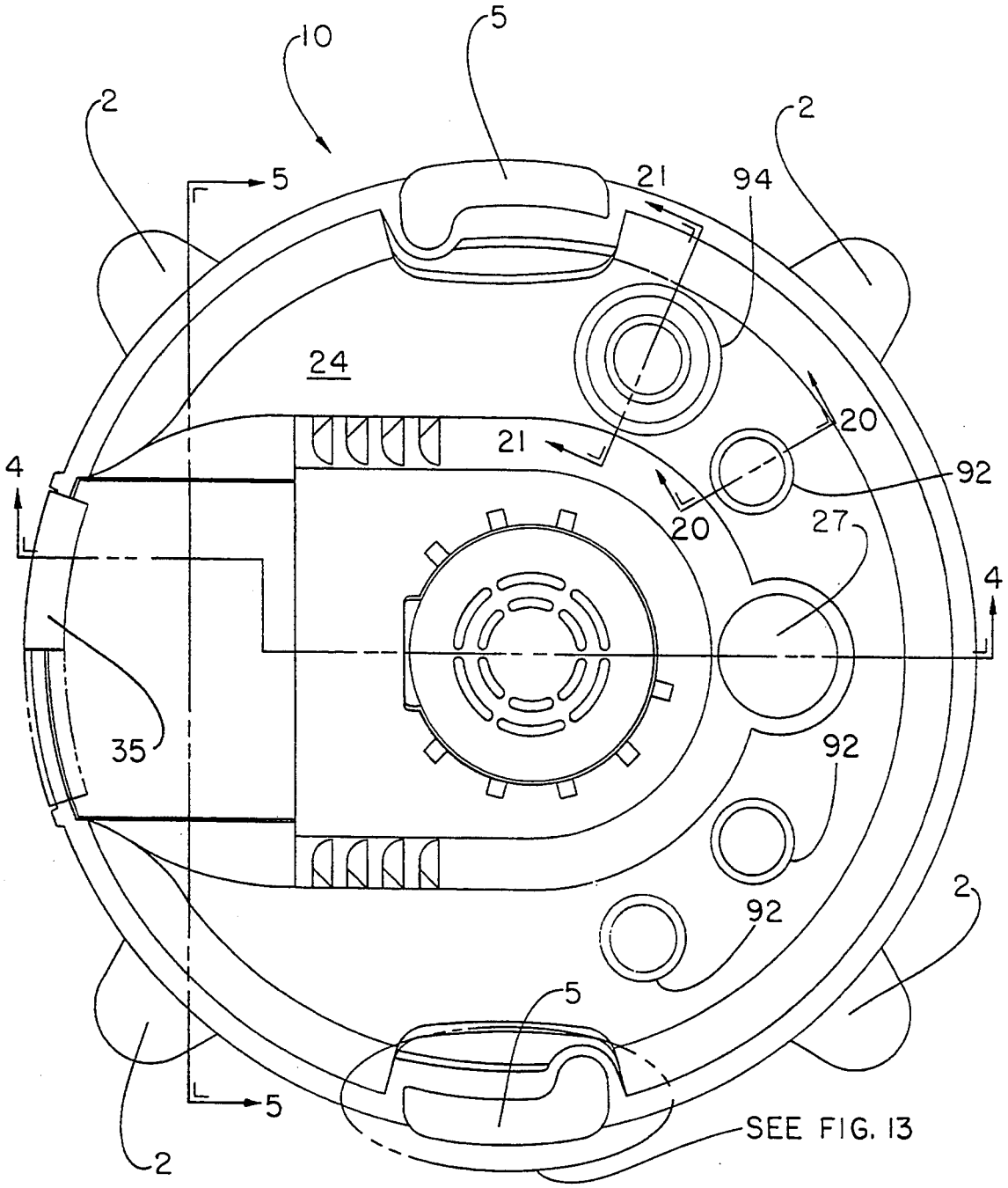
FIG. 3 is a top view of the tank type vacuum cleaner shown in FIG. 1 with vacuum accessories removed.

Referring to FIGS. 1 through 3, a wet/dry vacuum cleaner 10, of the utility tank type, is shown. Cleaner 10 typically comprises a bottom tank 20 and a power head or cover lid 24 removably and sealingly attached to bottom tank 20. Cover lid 24 is preferably affixed to tank 20 by two diametrically opposed latches 5. Tank 20 is typically supported upon four outrigger caster supports 2 having full swiveling castered wheels 4 attached thereto.

Figure 4:
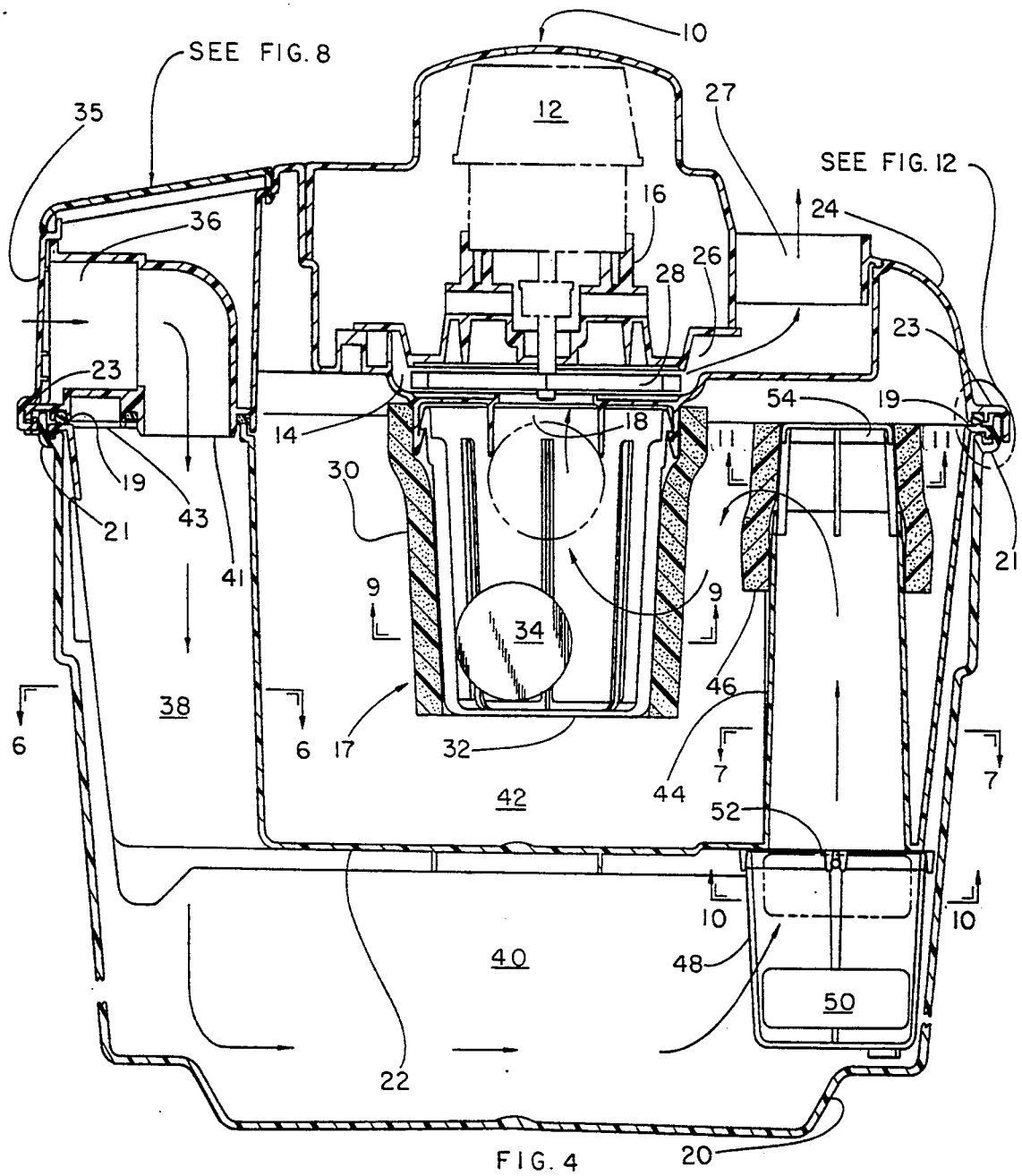
FIG. 4 is a cross-sectional view taken along line 4—4 of FIG. 3.
Figure 5:
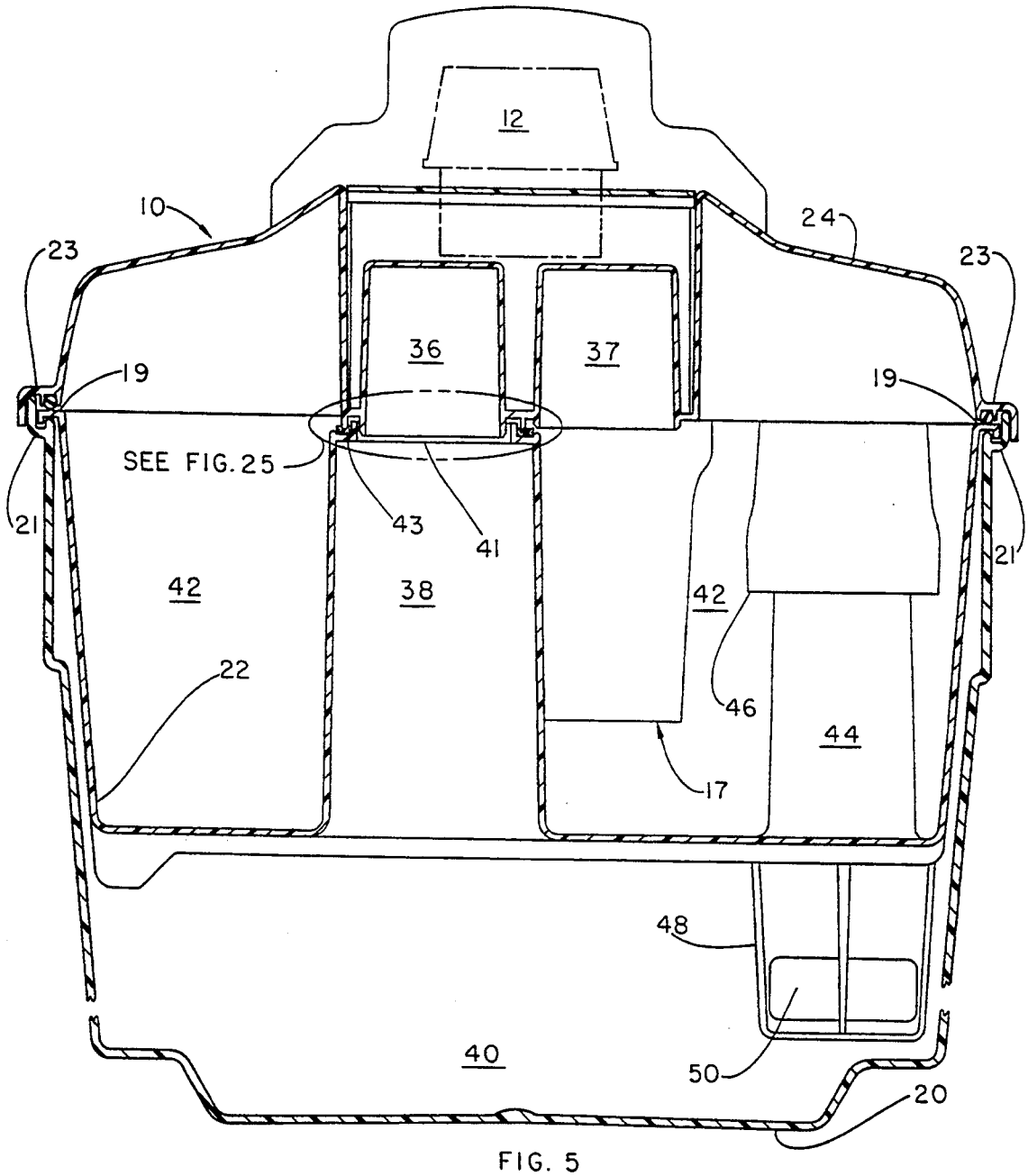
FIG. 5 is a cross-sectional view taken along line 5—5 of FIG. 3.
Figure 20:
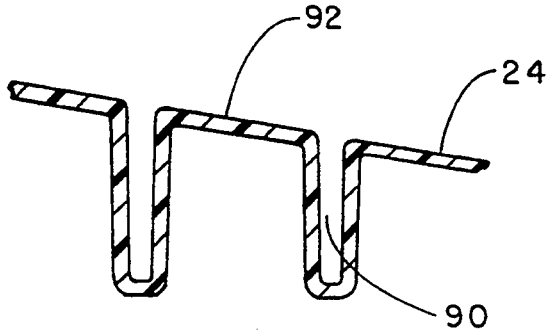
FIG. 20 is a cross-sectional view taken along line 20—20 of FIG. 3.
Figure 21:
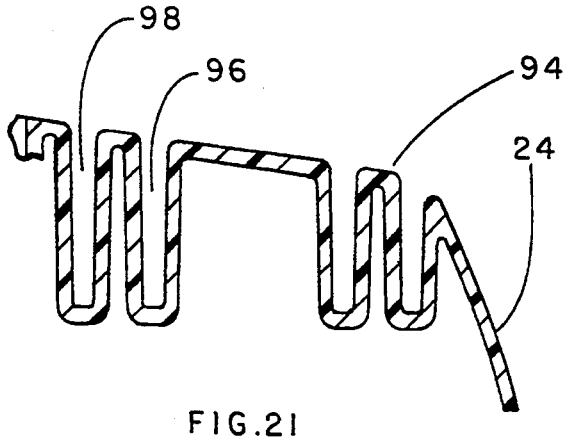
FIG. 21 is a cross-sectional view taken along line 21—21 of FIG. 3.
Figure 6:
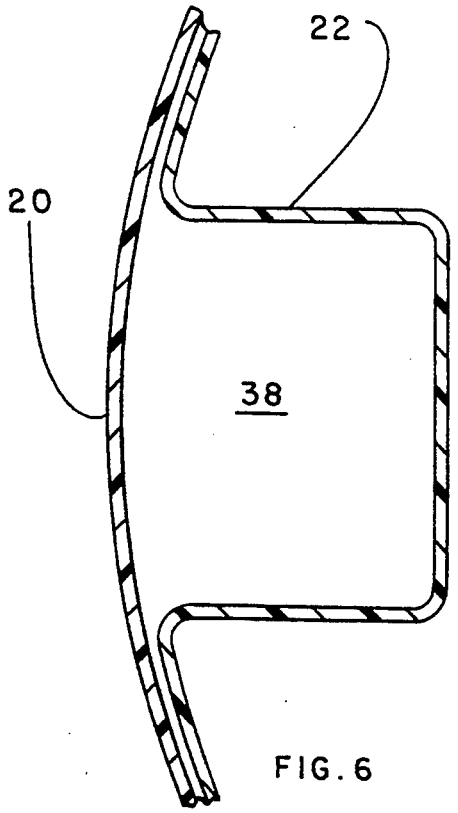
FIG. 6 is a cross-sectional view taken along line 6—6 of FIG. 4.
Figure 7:
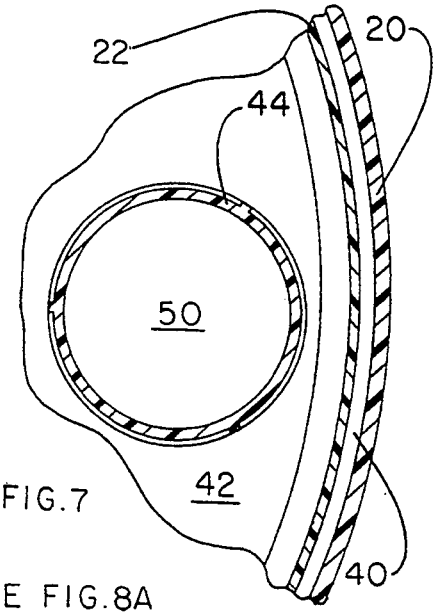
FIG. 7 is a cross-sectional view taken along line 7—7 of FIG. 4.
Figure 12:
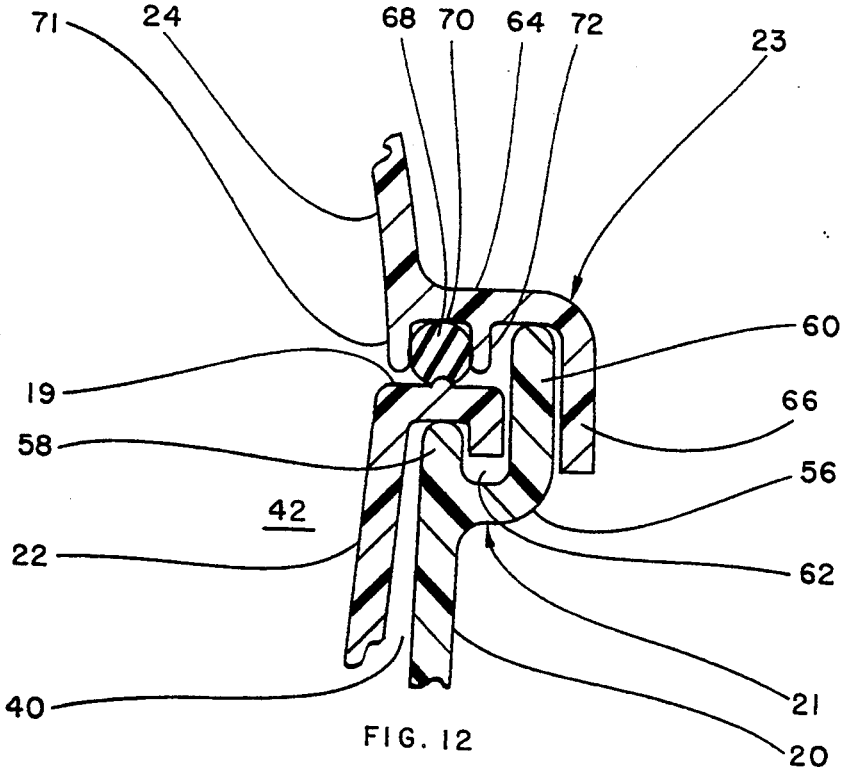
FIG. 12 is a partial and enlarged cross-sectional view showing the lid to tank seal as indicated in FIG. 4.

Referring further to FIGS. 4 and 5, telescopingly received within bottom tank 20 is inner tank 22 sealingly supported upon rim 21 of tank 20. Cover lid or power head 24 includes circumferential rim 23 which sealingly engages rim 19 of inner tank 22 and rim 21 of outer tank 20 as best illustrated in FIG. 12. The combination of bottom tank 20, inner tank 22 and lid 24 define two separate debris receiving chambers 40 and 42 within cleaner 10. Tank 22 is telescopingly received within tank 20 as seen in FIGS. 4 and 5. As can be readily observed the relative capacity of tank 40 with respect to tank 42 may be varied by extension or reduction of the respective tank side wall height. It is preferred that tank 20 receive and exclusively collect wet debris and vacuumed liquids; inner tank 22 is thereby intended for receipt of and exclusive collection therein of dry debris. The means for selectively directing wet and dry debris to tank 20 and 22 respectively is further discussed below.

Referring now to FIGS. 2, 4, 5, 6, and 7. Removable inner tank 22 incorporates a vertical inlet bypass 38 communicating with chamber 40 of wet tank 20, and exhaust tower 44 provides fluid communication between wet chamber 40 of tank 20 and dry chamber 42 of tank 22. Incorporated within cover 24 are two separate inlet ports 36 and 37. Inlet port 36 is intended for wet debris pickup and fluidly communicates directly with inlet bypass 38 thereby providing direct access to wet chamber 40 of tank 20. Inlet port 37, on the other hand, communicates directly with dry chamber 42 of dry tank 22.

Figure 25:
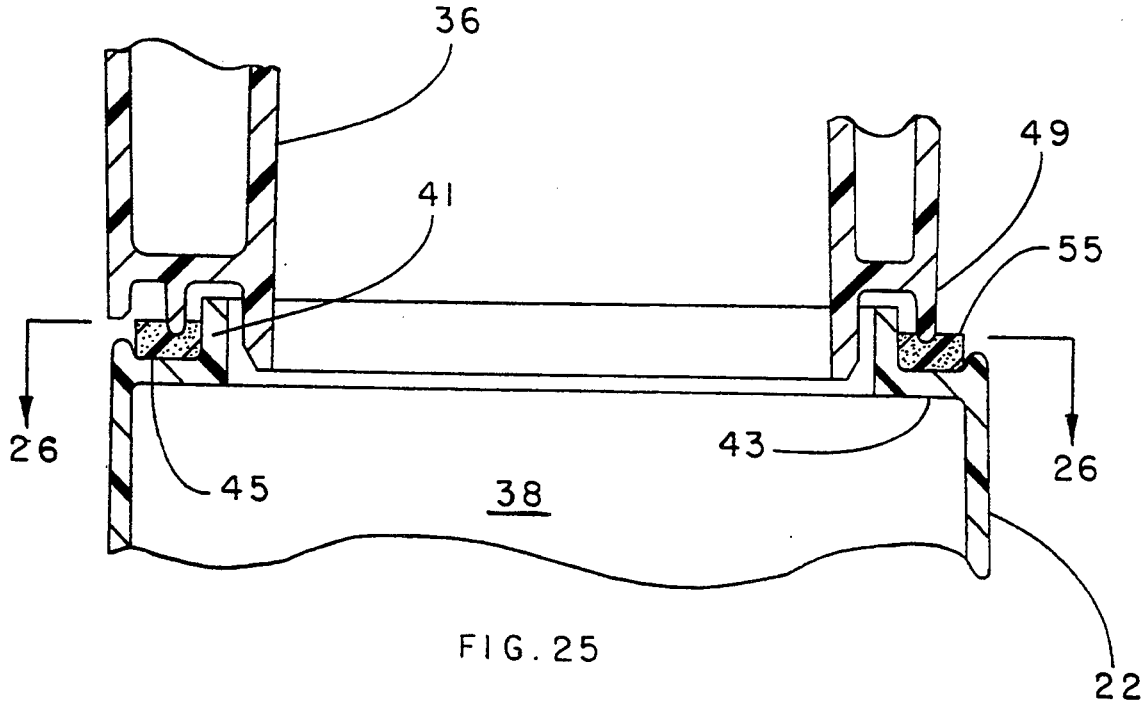
FIG. 25 an enlarged cross-sectional view of the wet inlet port seal as indicated in FIG. 5.
Figure 26:
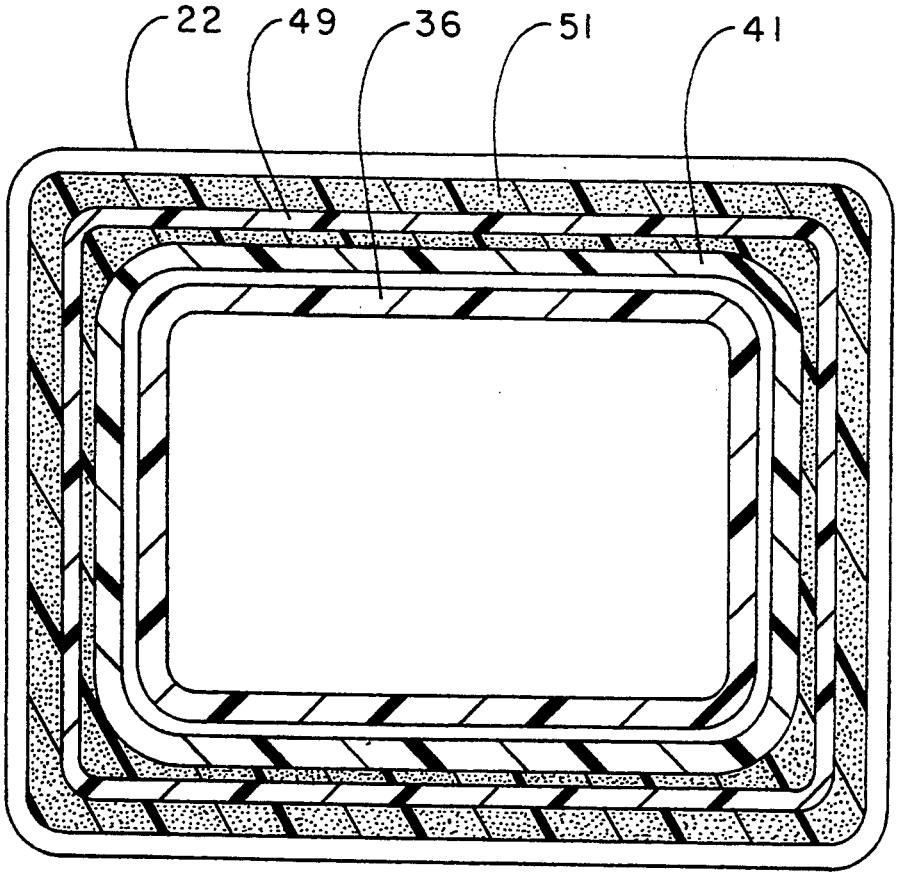
FIG. 26 is a cross-sectional view taken along line 26—26 of FIG. 25.

Wet inlet port 36 is sealingly received within rectangular aperture 41 of integrally molded top cover 43 of by-pass 38. As best seen in FIG. 25 and FIG. 26, aperture 41 is circumscribed by a seal receiving groove 45 having positioned therein a suitable elastomeric seal 55. Inlet port 36 is provided a circumscribing downwardly extending sealing rib 55 that when top cover 24 is placed upon bottom tank 20, rib 49 sealingly engages seal 55 slightly compressing seal 55 between groove 45 and rib 49 thereby affecting an airtight seal between inlet port 36 and by-pass 38.

Sliding valve door 35 freely translates left or right, as shown in FIG. 2 and 2A, thereby selectively sealing off inlet 36 or 37 as desired. When dry debris is being vacuumed, door 35 is positioned to the left, as seen in FIG. 2, and a suitable vacuum hose (not shown) is inserted into inlet port 37. Similarly when it is desired to vacuum wet debris, door 35 is positioned to the right, as shown in FIG. 2A, exposing wet inlet port 36 for vacuum hose insertion.

Figure 8A:
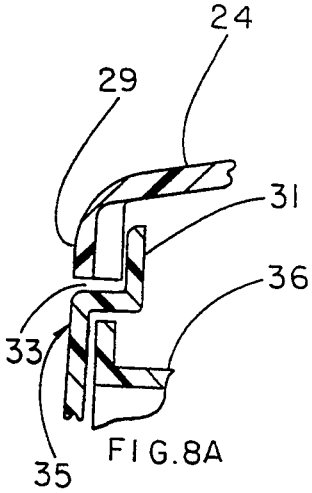
FIG. 8A is a partial and enlarged cross-sectional view showing the upper valve door attachment structure as indicated in FIG. 8.
Figure 8:
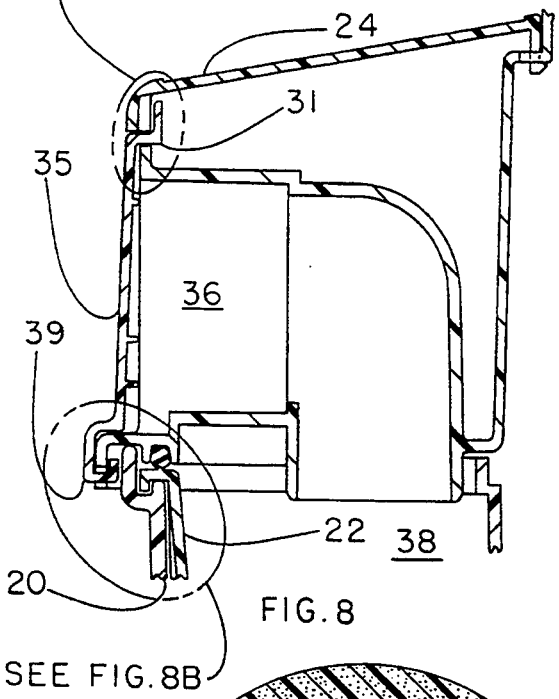
FIG. 8 is a partial and enlarged cross-sectional view showing the sliding valve door structure as indicated in FIG. 4.
Figure 8B:
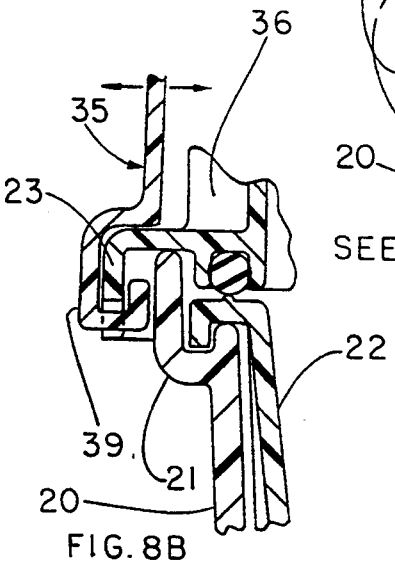
FIG. 8B is a partial and enlarged cross-sectional view showing the lower valve door attachment structure as indicated in FIG. 8.

Referring to FIGS. 8, 8A, and 8B the valving operation of valve door 35 will be described. Valve door 35, at the top thereof, is provided with an offset lip 31 extending through gap 33 between upper guide rail 29 of lid 24 and inlet port 36 and upward along the inside surface of guide rail 29 as illustrated in FIG. 8A. Valve door 35 is further provided, at the bottom thereof, "J" hook 39 which engages the downturned rim 23 of lid 24 as shown in FIG. 8B. It is to be noted that offset lip 31 and "J" hook 39 loosely engage guide rail 29 and rim 24, respectively, such that door 35 may move slightly inward and/or outward, as shown by the arrows in FIG. 8B, thereby permitting valve door 35 to be vacuum drawn against the selected inlet port 36 or 37 thus sealing off the selected port from the atmosphere and permitting vacuumed airflow exclusively through the open inlet port.

Figure 9:
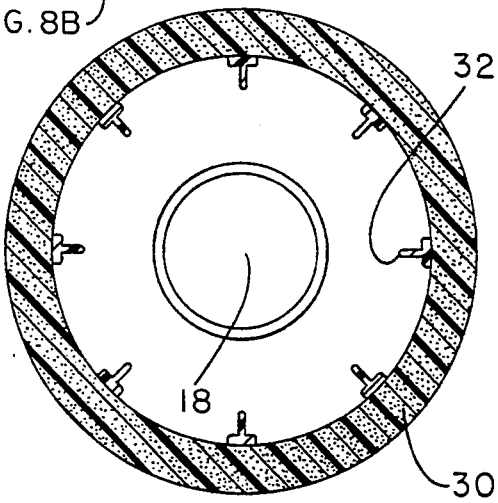
FIG. 9 is a cross-sectional view taken along line 9—9 of FIG. 4.
Figure 10:
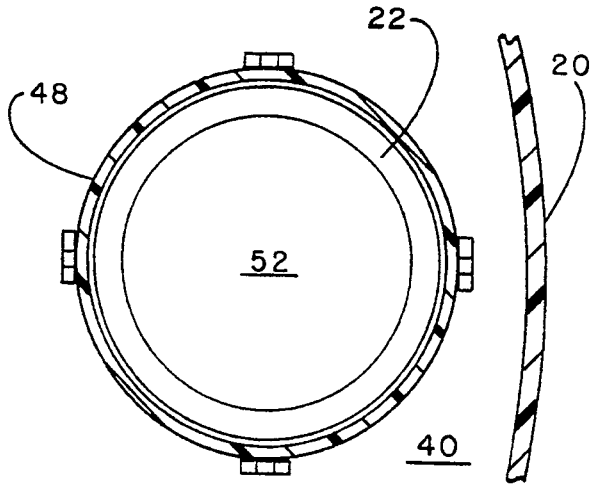
FIG. 10 is a cross-sectional view taken along line 10—10 of FIG. 4.
Figure 11:
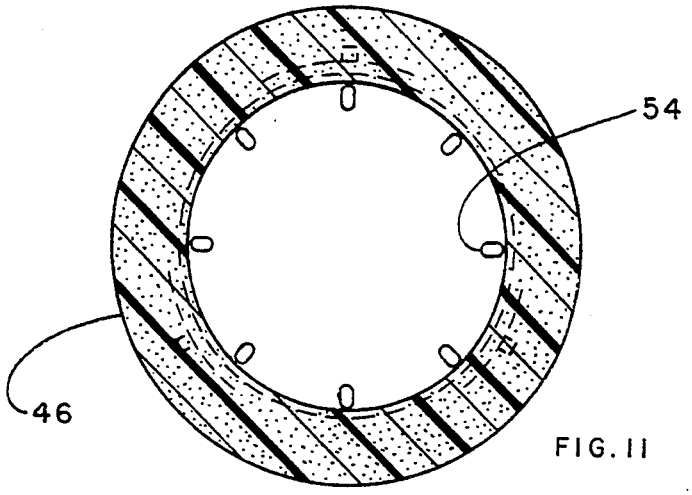
FIG. 11 is a cross-sectional view taken along line 11—11 of FIG. 4.

Referring again to FIG. 4, lid 24 has incorporated therein motor 12 supported upon suitable motor mounting structure 16. Motor mounting structure 16 in combination with lid 24 defines fan plenum chamber 14 having a centrifugal fan 28 therein. Fan plenum chamber 14 is provided with fan inlet eye 18 fluidly communicating with dry chamber 42 of inner tank 22 and fan exit 26 fluidly communicating with the cleaners exhaust port 27. Surrounding the fan eye 18 is a typical filter assembly 17 comprising a filter cage 32 suspended downward from lid 24 in any suitable manner and having a foam filter 30, or any other suitable filtering media, surrounding and cooperating with the filter cage (FIG. 9) so that only filtered air is permitted to enter into fan eye 18. A typical spherical float 34 is confined within filter cage 32 to act as a check valve as described further below.

Referring now to FIGS. 4, 7, 10, and 11, the entrance 52 to tower 44 is protected by float valve 50 confined within a typical float cage 48. Float 50, having a density less than water, is intended to rise with the level of fluid collected in wet chamber 40, of outer tank 20, sealing off the entrance 52 of tower 44 when the volumetric capacity of fluid in tank 20 is reached, thereby, preventing further wet pickup until tank 20 is emptied via drain plug 11 (FIGS. 1 and 2). Atop tower 44 is filter cage 54 having a moisture absorbing filter 46 thereabout and cooperating with cage 54 such that all air exiting tower 44 into chamber 42 must pass through filter 46 whereby little or no moisture passes into dry chamber 42.

Having described above the basic structure of vacuum cleaner 10, we now may appreciate its operation by referring to FIGS. 2, 4, and 5. When the user desires to operate the cleaner 10 in the wet pickup mode, valve door 35 is slidingly moved to the right, as illustrated in FIG. 2A, thereby exposing wet inlet port 36. A vacuum hose, with the desired vacuum nozzle (not shown) is inserted into wet inlet port 36 and the motor fan 12, is electrically activated thereby creating a vacuum inside inner tank 22 and outer tank 20 via tower 44. The presence of a vacuum inside cleaner 10 thereby causes valve door 35 to be drawn against the dry inlet port 37, as described above, thereby effectively sealing off dry inlet port 37 from the atmosphere. Following the flow arrows in FIG. 4, moisture laden air enters wet inlet port 36 and is immediately directed downward through bypass 38 into the liquid collection chamber 40 between outer tank 20 and inner tank 22 wherein the water and wet debris is collected and retained. From wet chamber 40 the vacuumed air, minus the suspended moisture and wet debris, passes upward through tower 44, into the dry collection chamber 42 between inner tank 22 and cover 24 exiting therefrom through exhaust port 27 via the filter assembly 17, eye 18 and fan plenum chamber 14. Filter 46 atop tower 44 is preferably a moisture absorbing filter to absorb any remaining moisture in the airflow as it passes therethrough into dry chamber 42.

Tower 44 is empirically sized and proportioned to cause suspended liquid particles in the rising airflow to drop back into wet collection chamber 40.

Similarly when dry vacuuming is desired, valve door 35 is slidingly positioned to the left, as viewed in FIG. 2, thereby sealing off wet inlet port 36 from the atmosphere and exposing dry inlet port 37 for use. Dirt laden air enters the cleaner via dry inlet port 37 directly into dry collection chamber 42 of inner tank 22. Dry debris is thereby collected and retained within tank 22. After depositing its dry debris within inner tank 22, the working air passes through filter 30, into fan plenum 14 and exits the cleaner through exhaust port 27.

As is evident by the above description, vacuum cleaner 10 may be alternately used to pickup wet or dry debris without modification of the cleaner, except for selectively positioning valve door 35. In the event the operator desires to operate cleaner 10 exclusively for wet or conclusively for dry pickup and would like to have the maximum storage capacity of outer tank 20, inner tank 22 may be conveniently removed thereby making available the total capacity of outer tank 20. When the cleaner 10 is exclusively used for wet pickup, with inner tank 22 removed, the ball float check valve 34 of filter assembly 17 provides the function of float 50, by choking the airflow into fan eye 18 when the liquid level rises to its maximum desired level. In the event the user inadvertently uses dry inlet port 37 for wet pickup with inner tank 22 installed, ball check valve 34 also serves to close off fan eye 18 when the liquid capacity of inner tank 22 is reached.

FIG. 12 shows the preferred sealing arrangement between cover lid 24, inner tank 22 and outer tank 20. The peripheral rim 21 of tank 20 comprises an upward opening "U" shaped channel 56 having an inner leg 58 and an outer leg 60 defining a peripheral groove 62 therebetween. Resting upon inner peripheral leg 58 is radially extending flange 19 of inner tank 22. The surface to surface contact between inner leg 58 of outer tank rim 21 and the undersurface of flange 19 forms a first vacuum seal between wet chamber 40 of outer tank 20 and the atmosphere. Alternatively an elastomeric seal may be placed between leg 58 and the under surface of flange 19 or within peripheral groove 62 to assure a perfect seal therebetween. As seen in FIG. 12 outer leg 60 of outer tank rim 21 extends above inner leg 58 engaging the under surface of radially extending peripheral flange 64 of cover lid 24. Preferably flange 64 terminates with a turned down edge 66 which circumferentially overlaps leg 60 of outer tank rim 21 thereby cooperating with leg 60 to properly position lid 24 upon tank 20. The interface contact between leg 60 and the under surface of flange 64 also serves to provide a second vacuum seal between wet chamber 40 and the atmosphere. Positioned between flange 64 of cover 24 and inner tank rim flange 19 is an elastomeric "O" ring seal 68. Preferably "O" ring seal 68 is retained within groove 70 by slightly compressing "O" ring 68 between groove legs 71 and 72. Thus chamber 42 between lid 24 and inner tank 22 is positively sealed off from wet chamber 40 of outer tank 20 and the atmosphere.

The "O" ring seal 68 between cover lid 24 and inner tank 22 is preferred to positively assure that no moisture, from wet chamber 40 of outer tank 20 will leak past the surface to surface seal provided by leg 58 of rim 21 and flange 19 of inner tank 22.

Figure 17:
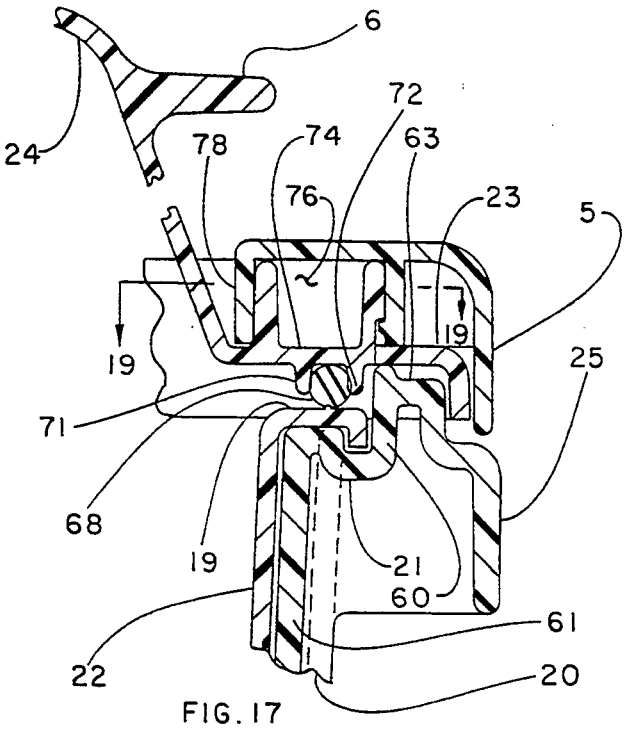
FIG. 17 is a cross-sectional view taken along line 17—17 of FIG. 13.

In the vicinity of outer tank hand holds 25 (see FIGS. 1, 2 and 17) the rim 21 of outer tank 20 and rim 19 of inner tank 22 are modified as shown in FIG. 17 to accommodate hand hold 25 and incorporate the lid to tank latch 5. To provide a lifting hand hold 25 on outer tank 20, tank wall 61 is slightly recessed, as shown in FIG. 17, and a radially extending projection 63 extends from outer leg 60 of outer tank rim 21 terminating with the downwardly extending hand hold 25. Aligned with hand hold 25 of outer tank 20, are lift handles 6, for removing cover 24, molded into the upper profile of lid 24 thereby providing an extended flange surface 74 upon which hollow cylindrical post 76 is integrally molded to rotatingly receive thereon arcuate latch lever 5.

Figure 18:
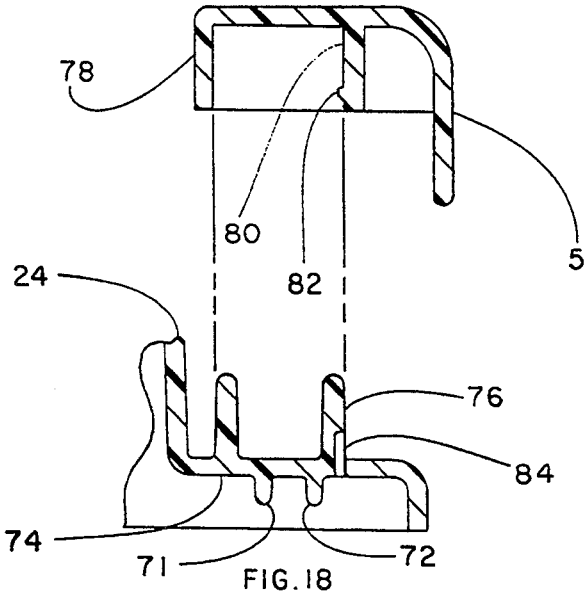
FIG. 18 is a cross-sectional view, similar to FIG. 17, showing the latch arm removed from the latch post.
Figure 19:
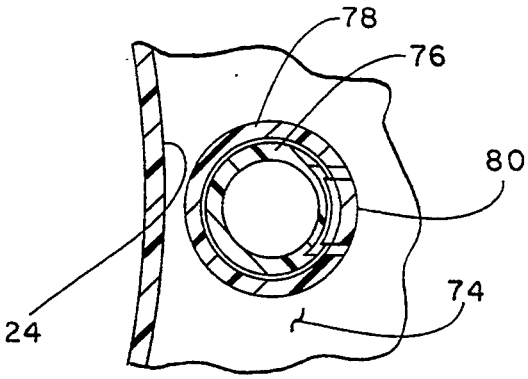
FIG. 19 is a cross-sectional view taken along line 19—19 of FIG. 17.

Referring now to FIGS. 13 through 19, the latching lever assembly and means by which lid 24 is secured to tank 20 will be described. As illustrated in FIGS. 18 and 19 arcuate latch lever 5 includes a hollow cylindrical pivot 78 which telescopingly receives therein hollow post 76. A cylindrical portion of hollow pivot 78 comprises a cantilevered spring 80, having a inwardly directed tab 82 at the free end thereof. Latching lever 5 is attached to hollow post 76 by sliding hollow pivot 78 downward over hollow post 76 until tab 82 snaps into the complimentary circular groove 84 on hollow post 76 thereby locking latch lever 5 upon hollow post 76. Circular groove 84 extends throughout an included angle sufficient to provide the necessary angular movement of latch lever 5 about post 76 to provide latching and unlatching of lid 24 to outer tank 20.

Figure 13:
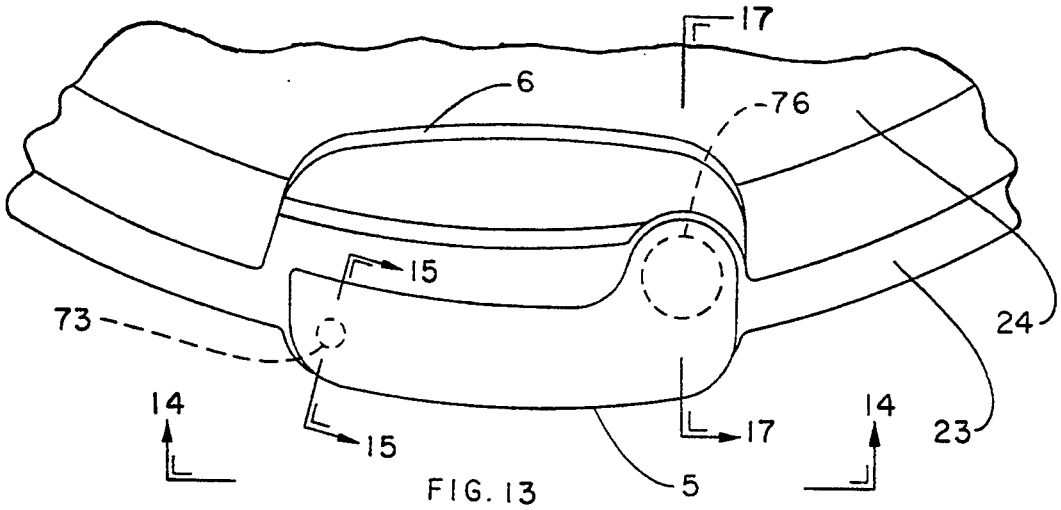
FIG. 13 is a partial and enlarged top view of the lid to tank latch as indicated in FIG. 3.
Figure 14:
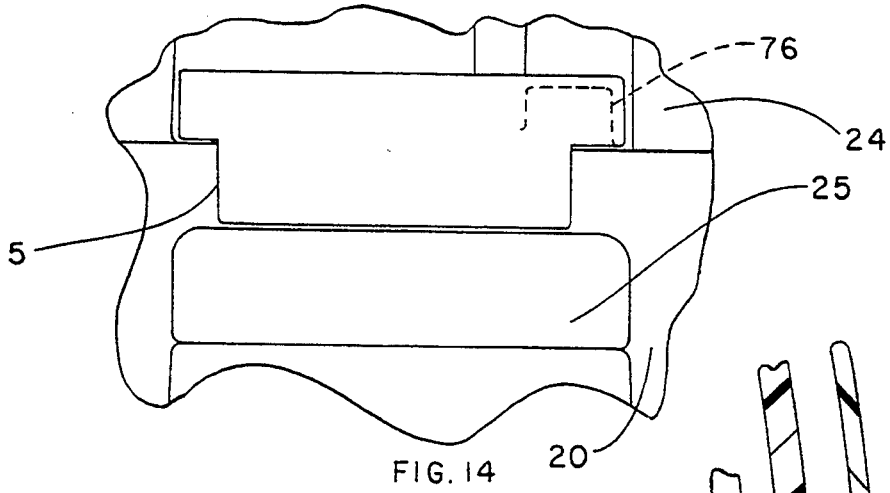
FIG. 14 is a partial elevational view taken long line 14—14 of FIG. 13 showing the vacuum cleaner lid latch.
Figure 15:
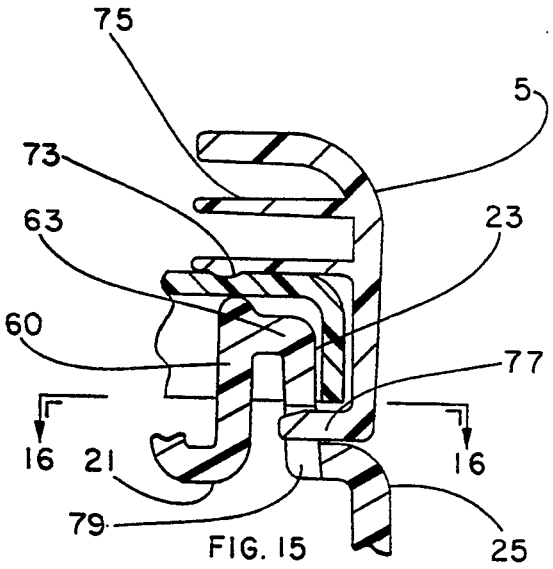
FIG. 15 is a cross-sectional view taken along line 15—15 of FIG. 13.
Figure 16:
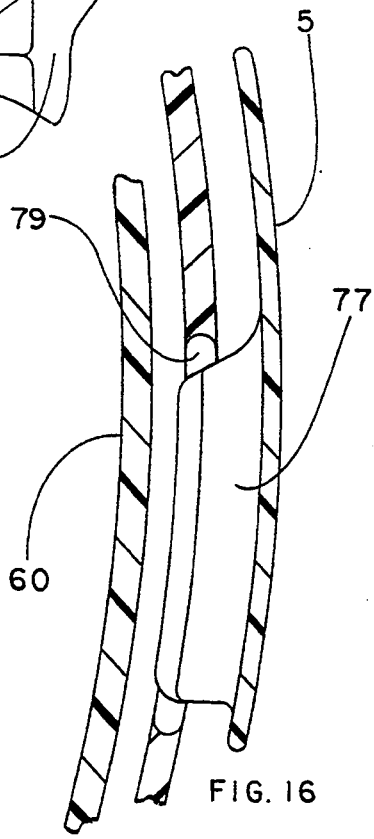
FIG. 16 is a cross-sectional view taken along line 16—16 of FIG. 15.

Latch lever 5 generally follows the peripheral curvature of rim 23 as illustrated in FIG. 13 and includes a radial inwardly extending shoulder 75 and parallel latching tang 77. When in the closed or latched position, as illustrated in FIGS. 13, 17, and 15, shoulder 75 of latch 5 frictionally engages the top horizontal surface of rim 23 and latching tang 77 is received within slot 86 of handle 25 thereby compressing therebetween rim 23 and the radial projection 63 of outer tank rim 21. Thus a vertical clamping force is applied between outer tank rim projection 63 and the underside surface of power head rim 23. Further "O" ring 68 is drawn down upon inner tank rim 19 thereby urging inner tank rim 19 against the rim 21 of outer tank 20. To remove power head 24, arcuate latch 5 is rotated outwardly from the cleaner thereby disengaging shoulder fram 75 from power head rim 23 and latching tang 77 from slot 79.

To prevent the inadvertent opening of latch 5 when subjected to the normal motor vibration during operation of the cleaner, shoulder 75 of latch lever 5 and rim 23 of power head 24 are preferably provided with an interlocking detent 73 which resists vibrational opening but permits manual disengagement.

As seen in FIGS. 1 through 3 and 20 and 21, the lid or cover is preferably provided with integrally molded vacuum tool accessory storage posts 92 and 94. Storage post 92 comprises a recessed cylindrical groove 90 defining a coaxial post 92 having a diameter approximately sized to frictionally receive thereupon a vacuum accessory tool such as nozzles 88 and 86 as illustrated in FIGS. 1 and 2.

Accessory storage post 94 comprises two recessed, concentric cylindrical grooves 96 and 98 thereby providing frictional storage posts for two different sized vacuum accessories.

Figure 23:
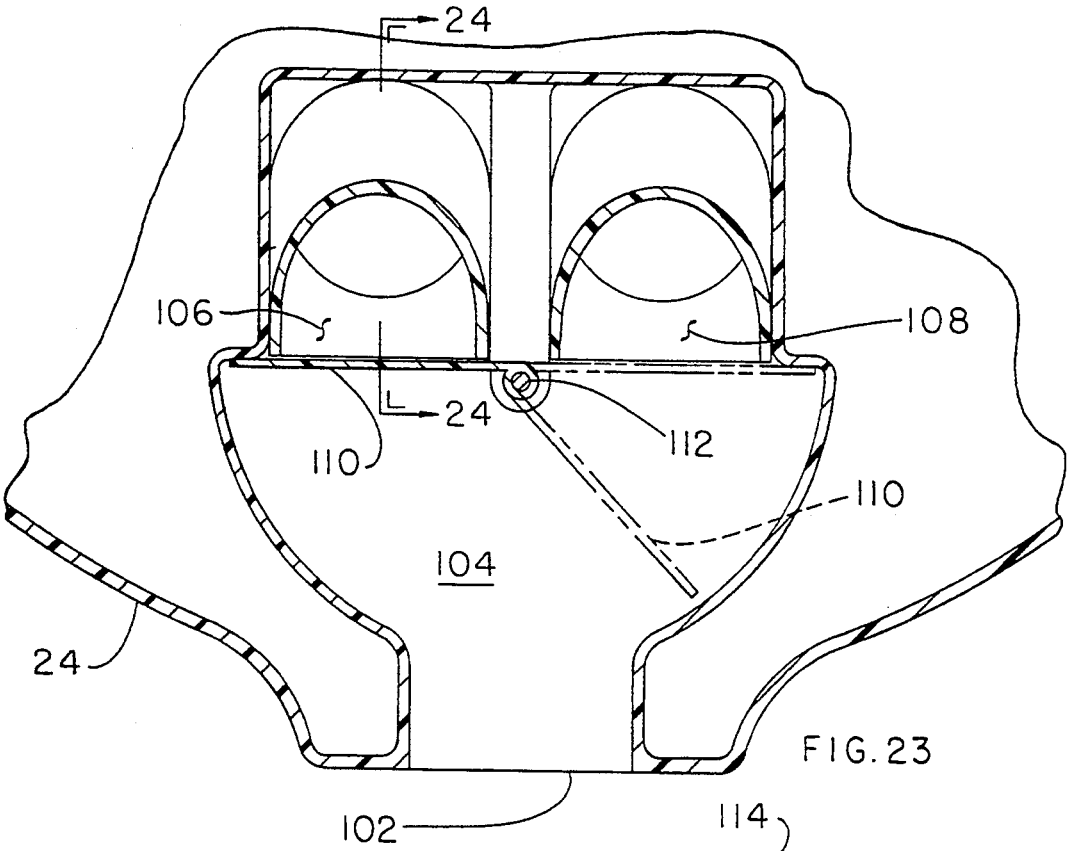
FIG. 23 is a cross-sectional view taken along line 23—23 of FIG. 22 showing an alternate valve door structure for use with the single vacuum inlet port as shown in FIG. 22.
Figure 22:
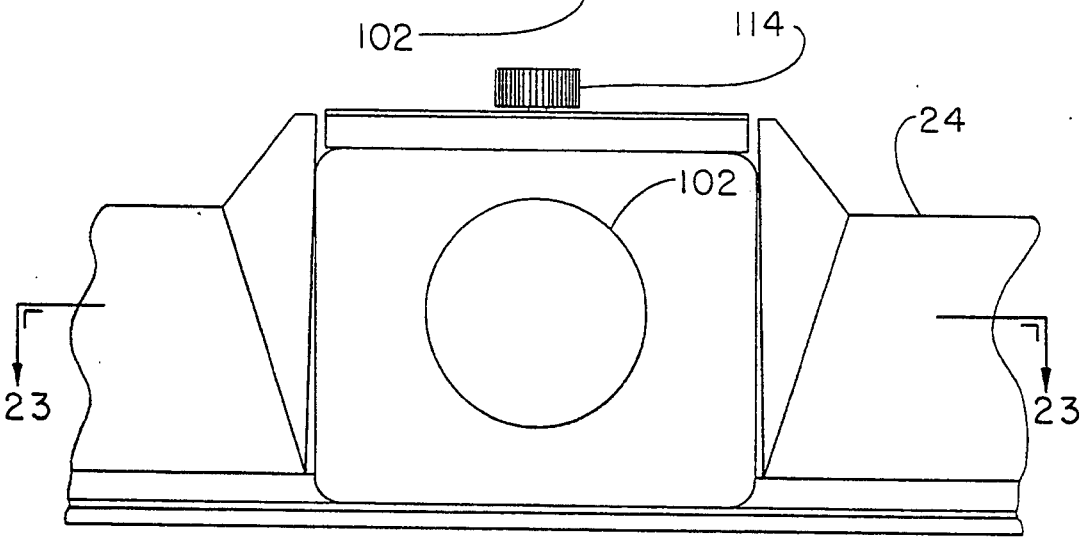
FIG. 22 is a partial front elevation view showing a single inlet vacuum port as an alternate embodiment.
Figure 24:
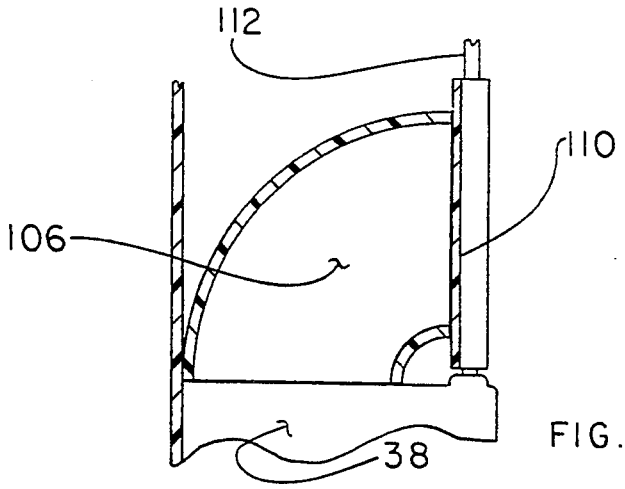
FIG. 24 is a cross-sectional view taken along line 24—24 of FIG. 23.

FIGS. 22 through 24 generally show an alternate embodiment wherein a single inlet port 102 is provided for insertion of a vacuum hose (not shown) thereby eliminating the need for the user to physically move the vacuum hose between the wet and dry inlet ports as is necessary in the above described preferred embodiment. Inlet port 102 fluidly communicates with manifold 104 which in turn has wet and dry inlet ports 106 and 108 respectively exiting therefrom. Inlet ports 106 and 108 function as inlet ports 36 and 37, respectively, as discussed above. Valve door 110 rotates about pivot shaft 112 by hand operation of knob 114 by the user to selectively choose wet or dry operation. When dry material is to be vacuumed, the operator rotates knob 114 clockwise thereby causing valve door 110 to close off wet inlet port 106 from manifold 104 and open dry inlet port 108 so as to receive dry debris entering manifold 104 via inlet port 102. Similarly when the operator desires to vacuum wet debris, wet inlet port 106 is opened and dry inlet port 108 is closed off and sealed from manifold 104 by rotating knob 114 counterclockwise. Wet and dry inlet ports 106 and 108 are configured within power head 24 to replace inlet ports 36 and 37 so as to fluidly communicate with wet bypass 38 and inner tank 22 (as shown in FIG. 5).

Although the invention has been described in detail with reference to the illustrated preferred embodiment, variations and modifications exist within the scope and spirit of the invention as described and as defined in the following claims.

We claim:

1. In a dual tank vacuum cleaner having a first open top concave main body tank, said open top having a circumscribing peripheral rim, and a second inner tank telescopingly received within said main body tank hangingly suspended from the peripheral rim of said main body tank, and a top cover sealingly engaging said tanks, the improvement wherein the peripheral rim of said main body tank comprises a peripheral, upwardly extending inner leg and a radially spaced apart upwardly extending outer leg, said outer leg extending above said inner leg and defining a peripheral groove therebetween, said inner tank having a peripheral rim comprising an outward radially extending flange sealingly supported upon the inner leg of said main body tank peripheral rim, said cover having an outwardly extending peripheral flange sealingly supported upon the outer leg of said main body tank peripheral rim.

2. The improvement as claimed in claim 1 including elastomeric sealing means between said top cover and said inner tank peripheral flange.

3. The improvement as claimed in claim 2 wherein said elastomeric sealing means comprises an "O" ring.

4. The improvement as claimed in claim 2 including elastomeric sealing means between said inner tank rim and said main body tank rim positioned within said main body tank rim peripheral groove.

5. The vacuum cleaner as claimed in claim 2 including clamping means between said main body tank rim and the peripheral flange of said top cover whereby said main body tank rim and the peripheral flange of said top cover are urged toward one another thereby compressing said elastomeric sealing means between said top cover peripheral flange and said inner tank peripheral flange.

6. The improvement as claimed in claim 1 including elastomeric sealing means between said inner tank rim and said main body tank rim.

7. The improvement as claimed in claim 4 wherein said elastomeric sealing means is positioned within said main body tank rim peripheral groove.

8. In a dual tank vacuum cleaner the improvement comprising:

a) a first open top debris receiving tank, said open top having a circumscribing peripheral rim;

b) a second open top debris receiving tank received within said first tank, said second tank hangingly suspended from said first tank peripheral rim;

c) a top cover;

d) sealing means associated with said first tank, said second tank, and said top cover, whereby said first and second debris receiving tanks are fluidly isolated from the atmosphere and from each other, thereby forming separate first and second debris receiving tanks.

9. The vacuum cleaner as claimed in claim 8 wherein said second tank is hangingly suspended from the peripheral rim of said first tank.

10. The vacuum cleaner as claimed in claim 9 wherein said sealing means includes an elastomeric seal between said top cover and said second tank.

11. The vacuum cleaner as claimed in claim 10 wherein said sealing means includes an elastomeric seal between said first and second tank.

12. The vacuum cleaner as claimed in claim 8 wherein said second tank sealingly engages said first tank.

13. In a dual tank vacuum cleaner:

a) a first open top debris receiving tank, said tank having a circumscribing peripheral rim;

b) a second open top debris receiving tank received within said first tank hangingly suspended from said first tank circumscribing rim;

c) sealing means between said first and second tanks;

d) a top cover;

e) sealing means between said top cover and said second tank.

14. In a dual tank vacuum cleaner:

a) a first open top debris receiving tank, said tank having a circumscribing peripheral rim;

b) a second open top debris receiving tank received within said first tank hangingly suspended from said first tank circumscribing rim;

c) sealing means between said first and second tanks;

d) a top cover;

e) sealing means between said top cover and said first tank.

* * * * *